United States Patent [19]

Gilbert

[11] Patent Number: 4,503,003

[45] Date of Patent: Mar. 5, 1985

[54] METHOD AND APPARATUS FOR VAPORIZING FUEL BY CENTRIFUGAL ACTION

[76] Inventor: Jack J. Gilbert, 3 River Rd., Suffern, N.Y. 10901

[21] Appl. No.: 512,278

[22] Filed: Jul. 11, 1983

[51] Int. Cl.[3] ..... F02M 17/16

[52] U.S. Cl. ..... 261/51; 261/88

[58] Field of Search ..... 261/88, 89, 51

[56] References Cited

U.S. PATENT DOCUMENTS

| | | | |
|---|---|---|---|
| 968,307 | 8/1910 | Yawger | 261/89 |
| 1,551,239 | 8/1925 | Desch | 261/88 |
| 2,223,836 | 12/1940 | Snyder | 261/88 |
| 2,351,072 | 6/1944 | Schmidt | 48/180 |
| 2,396,526 | 3/1946 | Nilsson | 261/89 |
| 2,689,116 | 9/1954 | Richardson | 261/51 |
| 3,711,257 | 1/1973 | Linn | 48/180 R |
| 3,946,717 | 3/1976 | England | 48/180 S |
| 3,991,143 | 11/1976 | Carter | 261/88 |
| 4,053,013 | 10/1977 | Guba | 165/86 |
| 4,149,853 | 4/1979 | Des Marais, Jr. et al. | 44/50 |
| 4,170,975 | 10/1979 | Wessel et al. | 261/88 |
| 4,264,539 | 4/1981 | Berg | 261/142 |
| 4,388,253 | 6/1983 | Maxwell | 261/88 |

FOREIGN PATENT DOCUMENTS

| | | | |
|---|---|---|---|
| 749179 | 7/1933 | France | 261/88 |
| 1366312 | 9/1974 | United Kingdom | 261/89 |

*Primary Examiner*—Tim Miles

*Attorney, Agent, or Firm*—Kenyon & Kenyon

[57] ABSTRACT

Liquid fuel is converted into gaseous form in an enclosed chamber rotating at high speed (e.g., 10,000 rpm). The fuel is delivered to a surface of a flat disc rotating about an axis perpendicular to the disc at the center. The fuel flows across the disc surface in a thin film to promote evaporation. Any unevaporated liquid fuel is retained by centrifugal force against the peripheral outer wall of the rotating chamber until the liquid completely vaporizes. The evaporated fuel mixes with air flowing into the chamber through an inlet opening opposite the disc evaporating surface. The mixture flows outwardly, around the edge of the disc, then inwardly between the back of the disc and the upstream edge of an annular baffle to exit from the chamber through an outlet opening of significantly smaller diameter than the maximum inner diameter of the chamber as a thorougly mixed dry gaseous combination of fuel and air.

14 Claims, 2 Drawing Figures

METHOD AND APPARATUS FOR VAPORIZING FUEL BY CENTRIFUGAL ACTION

BACKGROUND OF THE INVENTION

1. Technical Field.

The present invention relates to the conversion of liquid fuel to gaseous form and particularly to a method and apparatus for producing a flow of combustible gaseous mixture of fuel and air by centrifugal action for use in a combustion apparatus, particularly in an internal combustion engine.

2. Background Art.

Nonuniform mixing of fuel and air and fuel condensation in the intake passages of internal combustion engines are known to increase fuel consumption and pollution. Conventional venturi carburetors deliver liquid fuel in a finely-divided spray, part of which tends to condense upon cold intake passage walls. To assure that a combustible mixture will reach the cylinders, the carburetor must be adjusted to give a rich mixture during engine warm up. In addition, the delivery of fuel in the form of droplets makes it difficult to achieve completely uniform mixing with the intake air flowing through the carburetor.

Various proposals have been made for producing a homogeneous mixture of vaporized fuel and air by rotational mixing, sometimes in combination with heating or exposure to a gasifying catalyst, as in U.S. Pat. Nos. 2,351,072 of H. H. Schmidt, 4,053,013 of P. Guba, 4,264,539 of R. E. Berg, and 3,946,717 of England.

Schmidt introduces a fuel/air mixture from a carburetor or other source into a stationary chamber containing a disc-like rotor having vanes extending from the center to the circumference on both sides of the disc. The rotor disc subdivides the chamber into two halves, and the mixture is introduced into each half through a respective opening spaced from the axis of rotation approximately two-thirds of the radius of the chamber. The portions of the mixture entering these openings come into engagement with the rotor vanes and are given a violent centrifugal whirling motion, causing them to be thrown outwardly toward the periphery of the partitioning disc and into contact with the side walls of the chamber. The whirled mixture then leaves the chamber through a tangential outlet passage.

Guba imparts a centrifugal force to a fuel/air mixture supplied from a carburetor by passing the mixture through a rotor comprising a plurality of tubular members arranged in a circle and extending in directions that are slightly skewed from parallel to the axis of rotation. The tubular members are heated by a second fluid passing in contact with the outside surfaces of the tubes, so that the fuel/air mixture is pumped out of the tubular members centrifugally in a preheated condition.

Berg supplies fuel and air through separate coaxial tubes to the center of a squirrel cage type of centrifugal fan that rotates in a stationary housing which has a single off-center outlet. England discloses a fuel vaporizer having a flow-driven spinning bowl suspended from a conical sieve fixed in an inlet passage downstream from a carburetor. According to England, liquid fuel droplets impact the bottom of the bowl, and the captured liquid is centrifugally forced outward by the spin of the bowl. The bowl sides are described as directing the liquid flow to the backside of the sieve. Since the bowl rim is at the maximum diameter of the bowl, however, it would be inevitable that much of any captured liquid fuel would be sprayed outward from the rim of the spinning bowl into contact with the wall of the intake passage.

SUMMARY OF THE INVENTION

The applicant has discovered that, contrary to the teachings of the above-mentioned patents, imparting a strong rotational motion to a flow of air entraining sprayed droplets of liquid fuel does not necessarily improve the uniformity of mixing or promote the vaporization of all the fuel. In fact, the centrifugal forces acting on the rotating particles of the mixture tend to cause the heavier fuel particles to separate from the air and to condense on the surrounding stationary wall of the mixing chamber or the intake passage. Thus, centrifugal mixing devices can even aggravate the problem they are attempting to solve.

It is the principal object of the present invention to provide a method and apparatus for converting a flow of liquid fuel into essentially gaseous form by centrifugal action and for uniformly mixing the gaseous fuel with a flow of air for efficient burning in a combustion apparatus.

It is a further object of the invention to reduce the rotational velocity of a centrifugally mixed flow of air and fuel before the flowing mixture comes into contact with any stationary peripheral wall, so as to minimize centrifugal separation of the fuel from the air.

These and other objects are achieved by a method for providing a gaseous mixture of fuel and air to a combustion apparatus, and a device for performing the method.

The method comprises:

delivering a flow of volatile liquid fuel to a fuel chamber located inside an intake passage of a combustion apparatus, the fuel chamber having an axis of symmetry coincident with the axis of the intake passage and an upstream-facing surface extending transversely outward to a circumferential edge spaced radially inward from a peripheral outer wall of the chamber, and the fuel being delivered through an axial fuel conduit to flow onto the fuel distribution surface;

rotating the fuel distribution surface and the peripheral outer wall of the fuel mixing chamber about said axis of symmetry at sufficient velocity to spread the liquid fuel in a thin film across said fuel distribution surface for promoting evaporation of the fuel and to maintain by centrifugal force any liquid fuel discharged from the circumferential edge of the surface in contact with the peripheral outer wall until the fuel evaporates; and delivering a flow of air through the intake passage into the chamber through an inlet opening on the upstream side of the chamber and out of the chamber through an outlet opening on the downstream side of the chamber, the inlet and outlet openings being located closer to the axis of the chamber than the circumferential edge of the upstream-facing fuel distribution surface, and the peripheral outer wall extending from said inlet opening to said outlet opening, such that the flow of air passes over the fuel distribution surface, around the circumferential edge thereof, and then inwardly toward the axis of the chamber for thorough mixing with evaporated fuel before leaving the chamber through said outlet opening, and such that no liquid fuel is discharged through the outlet opening of the chamber.

Preferably, the method of the invention further comprises directing the flow of air radially inward around an annular baffle connected to the surrounding outer wall of the chamber adjacent to the outlet opening and extending in the upstream direction to terminate in an edge spaced axially from the downstream side of said transverse surface and radially inward from the peripheral outer wall for assuring that no liquid fuel is entrapped in the fuel/air mixture discharged through the outlet opening of the rotating chamber.

The device of the invention comprises:

a housing having an intake passage with an upstream end communicating with the atmosphere and a downstream end;

an enclosed fuel mixing chamber positioned centrally within the intake passage, said fuel mixing chamber having an axis of symmetry, axially spaced upstream and downstream walls extending transversely to said axis, each of said upstream and downstream walls having an opening therethrough for communicating the intake passage with the interior of the fuel mixing chamber, a fuel distribution member disposed between the upstream and downstream walls, said member having a surface facing the upstream wall and bounded by a peripheral edge, and a peripheral wall encircling said fuel distribution member in radially spaced relation to the peripheral edge of said member and connecting the upstream wall with the downstream wall;

means for supporting the fuel mixing chamber for rotation about its axis of symmetry within the intake passage;

a conduit for delivering liquid fuel to said surface of the fuel distribution member of the fuel mixing chamber via said supporting means; and means for rotating the fuel mixing chamber about said axis to force the fuel centrifugally across said surface in a thin film for promoting evaporation of the fuel and to maintain by centrifugal force any liquid fuel discharged from the peripheral edge of said surface in contact with the peripheral wall until the fuel evaporates and mixes with a flow of air through the fuel mixing chamber via said openings in the upstream and downstream walls.

Additional features and advantages of the invention are described below in connection with the preferred embodiment shown in the drawings.

BRIEF DESCRIPTION OF THE DRAWINGS

The invention will be more clearly understood by reference to the accompanying drawings and the associated detailed description.

DETAILED DESCRIPTION OF THE PREFERRED EMBODIMENTS

Figure 1:
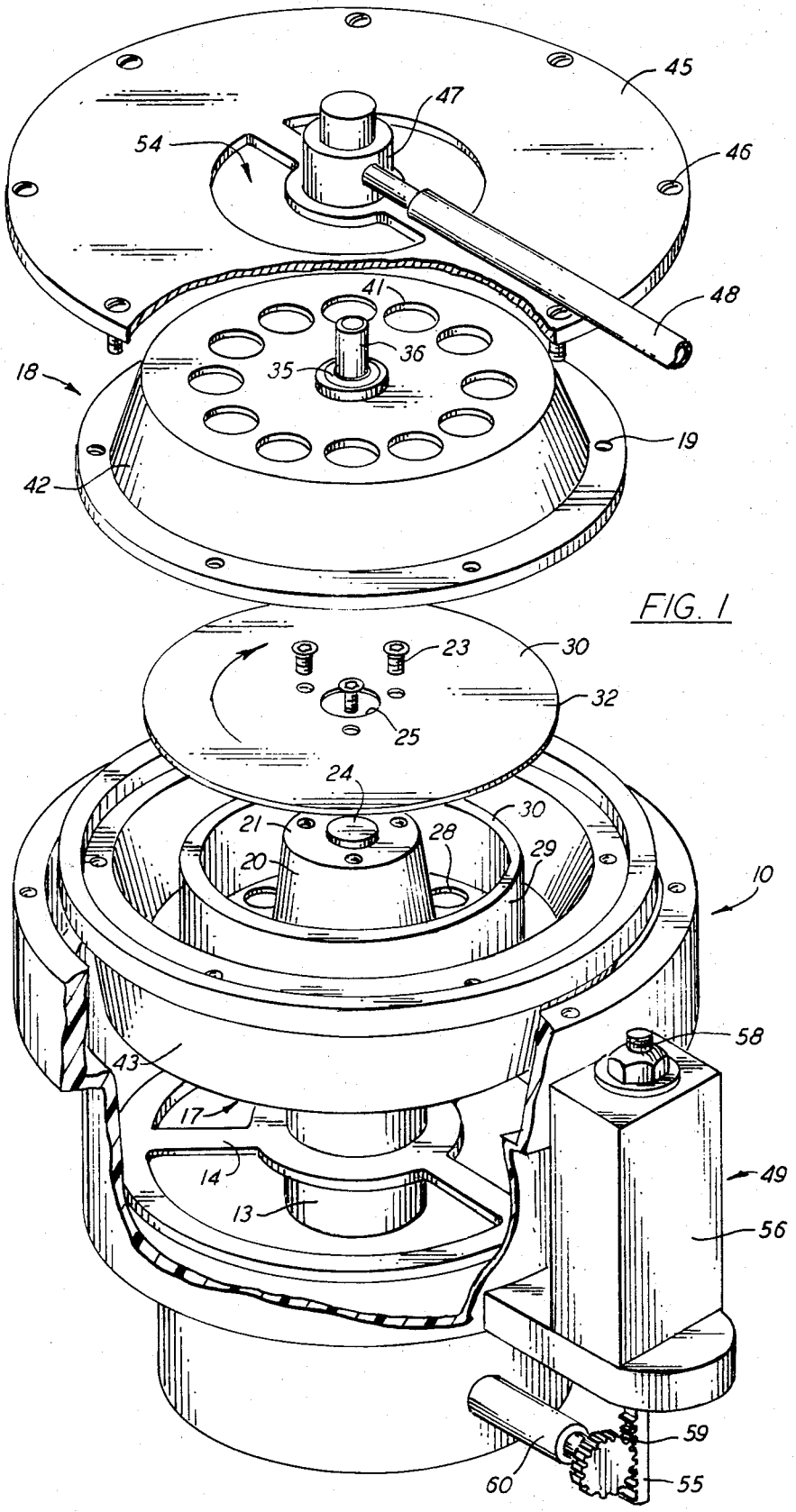
FIG. 1 is an exploded perspective view of a device according to the invention.
Figure 2:
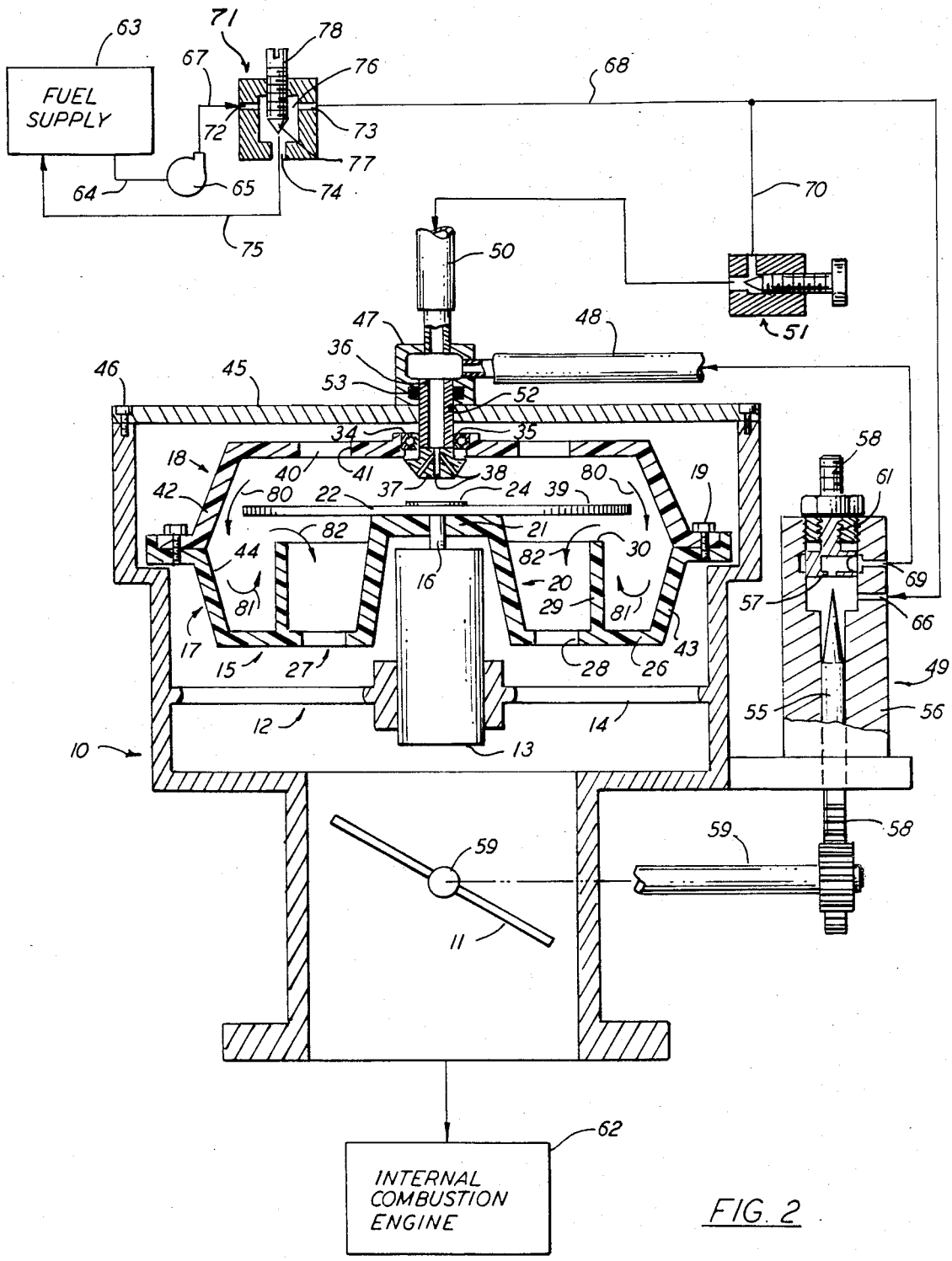
FIG. 2 is a simplified elevation view in cross section of the device of FIG. 1.

With reference to FIGS. 1 and 2, one embodiment of a device according to the invention has an intake housing 10 which is adapted for mounting on an intake manifold of an internal combustion engine in place of a conventional carburetor. The housing contains a throttle valve 11 positioned below a fuel/air mixing apparatus 12. The mixing apparatus includes an electric motor 13 centrally positioned by struts 14 in the housing and a fuel mixing chamber 15 fixed to the motor shaft 16.

The fuel mixing chamber is assembled from a lower cup-like shell 17 and an upper cup-like shell 18, which is inverted and fastened to the lower shell by screws 19 to form a leak-tight joint.

The lower shell 17 is formed with a raised central hollow boss 20 having a flat top 21 on which is mounted a flat disc 22 by suitable means such as screws 23. The flat top of the boss preferably is formed with a raised cylindrical stud 24 which mates with a hole 25 in the disc to center the disc in the chamber. The base of the lower shell 18 serves as a downstream wall 26 of the fuel mixing chamber, this wall having an outlet opening 27 coaxial with and closely adjacent to the central boss 20. The outlet opening may be formed by a plurality of holes 28 (for example, twelve) arranged in a circle around the boss. A baffle in the form of an annular wall 29 surrounds the outlet opening. The lower end of the baffle wall joins the downstream wall of the lower shell, and the upper end terminates in a circumferential edge 30 that is spaced axially from the downstream face 31 of the disc 22 and radially inward from the peripheral edge 32 of the disc.

The upper shell 16 has a flat top that serves as an upstream wall 33 of the fuel mixing chamber. A counterbored hole 34 in the center of the upstream wall carries a ball bearing 35 in the bore of which is fitted an axial fuel conduit in the form of a tube 36 having a head 37 drilled with passages 38 for delivering streams of liquid fuel onto the upstream-facing surface 39 of the disc 22. An inlet opening 40 through the upstream wall of the chamber coaxially surrounds the fuel conduit. As in the case of the outlet opening 27, the inlet opening 40 may be constituted by a plurality of holes 41 arranged in a circle. The inlet and outlet holes may be circular or any other convenient shape; in each case it is desirable that the total area of the inlet and openings be no smaller than the flow area provided past throttle 11 when it is fully opened.

The upstream and downstream walls of the fuel mixing chamber are joined to respective side walls 42 and 43, which together constitute a peripheral outer wall 44 of the fuel mixing chamber. Each of the side walls 42 and 43 is frusto-conical, so that the inner diameter of the peripheral wall of the chamber increases from the junctions of the respective side walls with the upstream and downstream walls to a maximum value at the junction of the two shells intermediate the upstream and downstream walls. Preferably the region of maximum diameter lies below (i.e., downstream) of a plane defined by the upstream edge of the baffle 29, for reasons that will be explained below in connection with the description of the operation of the device.

The assembly of the device is completed by a cover plate 45 that is fastened to the top of the housing by screws 46. The center of the cover plate is provided with a hollow block 47 which serves as a distributing connector for a fuel line 48 from a fuel metering valve 49, as well as for a fuel line 50 from an idling adjustment valve 51 (see FIG. 3). A central bore 52 extending through the upstream wall and the bottom of the hollow block slidingly receives the upper end of the fuel conduit tube 36, the connection being sealed by an O-ring 53.

As shown in FIG. 1, the cover plate 45 has an annular opening 54 surrounding the hollow block 47 to permit air to enter the upstream end of the housing. Because the clearance between the peripheral outer wall of the fuel mixing chamber and the wall of the intake passage through the housing is only enough to avoid contact (preferably about 1/16th inch), essentially all of the air flow will enter the inlet opening in the upstream wall of the fuel mixing chamber and will exit from the outlet opening in the downstream wall of the chamber.

The fuel metering valve 49 is a needle-type of valve having a valve rod 55 reciprocally mounted in a valve housing 56. The upper end of the rod comprises a needle valve which coacts with a seat 57. The axial position of the seat is adjustable by means of a screw 58 at the top of the valve housing. The lower end of valve rod 55 is provided with a row of teeth to form a rack 59. Valve housing 56 is mounted on the side of intake housing 10 so that the axis of valve rod 55 is perpendicular to a plane containing the axis of a shaft 60 carrying the butterfly valve 11. In FIG. 2 this shaft is turned 90 degrees for clarity in showing the butterfly throttle valve 11.

The other end of butterfly valve shaft 60 may be connected by a conventional crank arrangement to an accelerator pedal. It is apparent that the rack and pinion combination provides a direct conversion of angular rotation of the throttle valve to linear movement of the fuel needle valve 55. The previously-mentioned valve seat 57 mounted on the lower end of screw 58 is adjustable axially by rotation of the screw in an internally threaded sleeve 61 having also an externally threaded body screwed into the upper end of the valve housing. This axial adjustment of the valve seat provides a simple means to set the opening of the fuel metering valve in relation to the opening of the throttle valve. If desired, this adjustment can be used to obtain a proper idling mixture, and the separate idling adjustment valve 51 can be eliminated.

As shown in FIG. 2, the fuel/air mixing device 10 is intended to be connected to a combustion apparatus, as by mounting on the intake manifold of an internal combustion engine 62 in place of a conventional carburetor. Liquid fuel, such as gasoline, from a fuel tank 63 is fed through a supply line 64 to a fuel pump 65. The pump delivers fuel under pressure to inlet port 66 of the fuel metering valve via lines 67 and 68. An amount of fuel determined by the opening of the needle valve 55 flows from outlet port 69 via line 48 to the distribution block 47. A preset amount of fuel may also be delivered from line 68 via line 70 to the idling adjustment valve 51, if such a separate valve is used. As shown, valve 51 may be a conventional, manually adjustable needle valve.

It has been found that fuel delivery by the device is sensitive to the delivery pressure from the fuel pump. The optimum pressure range is $1\frac{1}{2}$ to 2 psi, but mechanical fuel pumps, for example, may have an output pressure that varies from 4 to 6 psi. A simple yet effective way to reduce pressure fluctuations and to obtain the optimum pressure at the inlet of the fuel metering valve is to provide an adjustable bypass valve 71 in the supply line. Valve 71 has an inlet port 72 connected to fuel line 67, an outlet port 73 connected to fuel line 68, and a bypass port 74 connected to a fuel return line 75 leading back to the supply tank. Inlet port 72 communicates internally with outlet port 73 via a valve chamber 76 surrounding a needle valve 77. The needle valve has a threaded stem 78 to permit adjustment of the spacing of the valve with respect to its seat 79, the seat leading to the bypass port 74. As the valve is opened, a greater portion of the output from the fuel pump is bypassed and returned to the supply tank, causing the supply pressure in the valve chamber to drop and pressure variations to diminish. As a result, the pressure delivered to the fuel metering valve can be maintained substantially constant at an optimum value under all operating conditions of the engine with only a single presetting adjustment of the bypass needle valve.

In addition to connection to a fuel supply, the mixing device 10 also requires connection to an electric power source, such as a battery (not shown), through an ignition switch (not shown) for operating the electric motor 13. It is also desirable to provide an electrically actuated shut off valve (not shown) in the fuel supply line, particularly if the engine is equipped with an electric fuel pump. The electric valve should be controlled by a switch responsive to engine operation, such as a vacuum switch actuated by intake manifold vacuum, so that the fuel supply will be positively shut off if the engine stalls, to prevent flooding. The arrangement of an electric control arrangement for a fuel supply shut off valve is more fully described in the applicant's copending U.S. patent application Ser. No. 06/368,182 filed on Apr. 14, 1982, the disclosure of which is incorporated herein by reference.

The operation of the device should be apparent from the foregoing description, but it will be briefly described for sake of completeness. When the engine ignition switch is turned on, the electric motor 13 will be energized, causing the fuel mixing chamber to start to spin. Closing of the starter switch to crank the engine will create sufficient vacuum in the intake manifold to actuate the vacuum switch and open the fuel supply line. Fuel will then flow through the idle adjustment valve 51, or through the fuel metering valve 49 if there is no separate idle adjustment valve, to the distribution block 47, then down through tube 36 and passage 38 in head 37 to flow onto the spinning disc 22.

When the liquid fuel contacts the upper surface 39 of the disc, it spreads rapidly outward in a thin film under the influence of centrifugal forces induced by the disc. The thin film promotes evaporation of the fuel from the surface of the disc. Any unevaporated liquid that reaches the edge of the disc is flung outward into contact with the peripheral outer wall 44 of the spinning chamber. Since all parts of the mixing chamber (except the stationary fuel supply head 37) rotate at the same angular velocity, liquid fuel contacting any internal surface of the chamber will be subjected to a centrifugal force that increases with distance from the axis of rotation. Thus, any unevaporated fuel in the chamber will tend to end up at the region of maximum circumference of the peripheral outer wall of the chamber. There, the high surface speed of the spinning wall will spread the fuel into an extremely thin layer which will rapidly evaporate.

Meanwhile, air from the surrounding atmosphere will be drawn into the cranked engine through the annular opening 54 in the cover plate of the housing, then into the inlet opening 40 of the chamber, over and around the edges of the disc 22 and the baffle 29, and out of the chamber through the outlet opening 27, to flow past the throttle valve 11 into the intake manifold. A strong turbulence is imparted to the air flowing through the inlet holes 41. This turbulence enhances the mixing of the air with evaporated fuel from the surface of the disc.

The incoming air also is given a circular rotation, or swirl, as it passes through the inlet holes and then flows in contact with the spinning surfaces of the chamber. The swirl motion, as well as the generally outward flow of the air over the upper surface of disc 22 and the abrupt change of direction of flow around the edge of the disc, imparts an outward momentum to any particles of liquid fuel that may be entrained in the air flow, either from the streams leaving the passages 38 or from droplets splashed up from the streams when they strike the surface of the disc.

As a result of the outward momentum, the entrained liquid particles will be thrown against the peripheral outer wall of the chamber as the mixture flows around the edge of the disc, and the high circumferential speed of the peripheral wall will hold the separated liquid until it completely evaporates. It should be noted, moreover, that the design of the fuel mixing device minimizes liquid fuel entrainment in the first place, by bringing the air into the chamber radially outward from the fuel and by placing the supply head close to the spinning disc.

After the mixture of air and completely vaporized fuel flows around the edge of the disc 22, as shown by arrows 80, it is guided into a toroidal circulation, as shown by arrows 81, by the converging lower peripheral wall 43 and the outer wall of the baffle 29. This circulation tends to separate any remaining liquid fuel particles from the stream of air and vaporized fuel before the dry mixture flows over the edge of the baffle (arrows 82) and through the outlet holes 28. Liquid particles that strike the baffle or the bottom surface of the chamber will tend to move under centrifugal force toward the region of maximum diameter. In the disclosed embodiment, this region is located axially downstream of the edge of the baffle. This location removes the liquid film from the direct path of air flow over the baffle, thereby further minimizing the possibility of liquid particles becoming entrained in the flow of air.

Additional turbulence is imported to the mixture as it flows through the outlet holes, but the circular momentum of the outflowing mixture is reduced by locating the outlet holes as close as practical to the axis of rotation. Thus, the mixture leaving the chamber is thoroughly and turbulently mixed, but it does not have a high centrifugal component. That is, the flow does not have a high rotational velocity because it leaves the mixing chamber through an outlet opening having a relatively small diameter. As a result, any possible tendency for the vaporized fuel to separate from the air and condense on the walls of the intake passage is greatly reduced.

Most importantly, however, the design of the mixing chamber assures that all liquid fuel particles are maintained in contact with a rapidly rotating surface until the liquid is completely vaporized to particles of essentially molecular dimensions. The liquid fuel is thus converted into a dry gaseous vapor. The vapor is thoroughly mixed with the turbulent air stream before the mixture enters the intake passage, and the potential for subsequent condensation of any fuel prior to entry of the mixture into a combustion chamber of an engine is negligible.

Although the invention has been described in connection with its application to internal combustion engimes, as a replacement for a conventional carburetor, the method and apparatus is also applicable for use with other types of combustion apparatus, such as furnaces and boilers. The essentially complete evaporation of the liquid fuel and the subsequent turbulent mixing of the dry vapor with air produce a highly uniform combustible mixture that is substantially immune to recondensation of the fuel during its flow to the combustion chamber of the apparatus.

I claim:

1. A method for providing a gaseous mixture of fuel and air to a combustion apparatus, the method comprising:

delivering a flow of volatile liquid fuel to a fuel chamber located inside an intake passage of a combustion apparatus, the fuel chamber having an axis of symmetry coincident with the axis of the intake passageway and an upstream-facing fuel distribution surface extending transversely outward to a circumferential edge spaced radially inward from a peripheral outer wall of the chamber, and the fuel being delivered through an axial fuel conduit to flow onto the fuel distribution surface, rotating the fuel distribution surface and the peripheral outer wall of the fuel mixing chamber about said axis of symmetry at sufficient velocity to spread the liquid fuel in a thin film across said fuel distribution surface for promoting evaporation of the fuel and to maintain by centrifugal force any liquid fuel discharged from the circumferential edge of the surface in contact with the peripheral outer wall until the fuel evaporates; and delivering a flow of air through the intake passage into the chamber through an inlet opening on the upstream side of the chamber and out of the chamber through an outlet opening on the downstream side of the chamber, the inlet and outlet openings being located closer to the axis of the chamber than the circumferential edge of the upstream-facing fuel distribution surface, and the peripheral outer wall extending from said inlet opening to said outlet opening, such that the flow of air passes over the fuel distribution surface, around the circumferential edge thereof, then inwardly toward the axis of the chamber and around an annular baffle connected to the downstream side of the chamber adjacent to the outlet opening and extending in the upstream direction to terminate in an edge spaced axially from the downstream side of said transverse surface and radially inward from the surrounding outer wall for thorough mixing with evaporated fuel before leaving the chamber through said outlet opening and for assuring that no liquid fuel in entrapped in the fuel/air mixture discharged through the outlet opening of the rotating chamber, such that no liquid fuel is discharged through the outlet opening of the chamber.

2. The method of claim 1 wherein the step of rotating the fuel chamber comprises rotating the chamber at a speed on the order of 10,000 rpm.

3. The method of claim 1, further comprising the steps of:

throttling the flow of gaseous fuel/air mixture through the intake passage downstream of the fuel chamber in accordance with demand by the combustion apparatus and controlling the flow of liquid fuel into the fuel chamber in response to the throttling of fuel/air mixture to obtain a desired ratio of fuel and air in accordance with the demand of the combustion apparatus.

4. The method of claim 3, further comprising:

supplying the flow of fuel from a pressurizing source and returning a portion of the supplied fuel to the source via a restriction prior to said controlling step for reducing pressure fluctuations in the supply of fuel.

5. A device for supplying a flow of a gaseous mixture of fuel and air to a combustion apparatus, the device comprising:

a housing having an intake passage with an upstream end communicating with the atmosphere and a downstream end;

and enclosed fuel mixing chamber positioned centrally within the intake passage, said fuel mixing chamber having an axis of symmetry, axially spaced upstream and downstream walls extending transversely to said axis, each of said upstream and downstream walls have an opening therethrough for communicating the intake passage with the interior of the fuel mixing chamber, a fuel distribution member disposed between the upstream and downstream walls, said member having a surface facing the upstream wall and bounded by a peripheral edge, a peripheral wall encircling said fuel distribution member in radially spaced relation to the peripheral edge of said member and connecting the upstream wall with the downstream wall, and an annular baffle extending in the upstream direction from the downstream wall between the outlet opening and the junction of the downstream wall with the peripheral wall, the baffle having an upstream circumferential edge spaced axially downstream from the fuel distribution member and having a diameter less than the diameter of the bounding edge of the fuel distribution member;

means for supporting the fuel mixing chamber for rotation about its axis of symmetry within the intake passage;

a conduit for delivering liquid fuel to said surface of the fuel distribution member of the fuel mixing chamber via said supporting means; and means for rotating the fuel mixing chamber about said axis to force the fuel centrifugally across said surface in a thin film for promoting evaporation of the fuel and to maintain by centrifugal force any liquid fuel discharged from the peripheral edge of said surface in contact with the peripheral wall until the fuel evaporates and mixes with a flow of air through the fuel mixing chamber via said openings in the upstream and downstream walls.

6. The device of claim 5 wherein said fuel chamber is disposed coaxially in said intake passage.

7. The device of claim 5 wherein the fuel distribution member comprises a flat disc mounted coaxially with and perpendicularly to the axis of symmetry of the fuel mixing chamber.

8. The device of claim 5 wherein the outside of the impermeable peripheral wall of the fuel mixing chamber is closely spaced from the inside surface of the intake passage of the housing for minimizing leakage of air through the intake passage around the outside of the fuel mixing chamber.

9. The device of claim 5 wherein the means for rotating the fuel chamber comprises an electric motor.

10. The device of claim 9 wherein the electric motor is adapted to rotate the fuel chamber at approximately 10,000 rpm.

11. The device of claim 5 wherein the internal diameter of the peripheral wall of the fuel mixing chamber increases from the junctions of the peripheral wall with the upstream and downstream walls to a maximum value at a region intermediate the upstream and downstream walls.

12. The device of claim 11 wherein the maximum internal diameter of the peripheral wall of the fuel mixing chamber is at a region spaced downstream from the circumferential edge of the annular baffle.

13. The device of claim 5, further comprising:

a fuel metering valve in said conduit for controlling the flow of liquid fuel therethrough;

a throttle valve positioned in the intake passageway for controlling the flow of gas therethrough; and means coupling the fuel metering valve and the throttle valve for operating said valves together to provide a predetermined relation between fuel flow and gas flow.

14. The device of claim 13 wherein the fuel metering valve comprises a needle valve having a circular seat and a valve shaft mounted for longitudinal movement coaxially with said seat and having a taper at one end engageable with said seat to shut the valve;

the throttle valve comprises a butterfly valve mounted on a diametral shaft between the fuel mixing chamber and the downstream end of the intake passageway, the fuel needle valve being mounted so the axis of its valve shaft is perpendicular to a plane containing the axis of the diametral shaft of the throttle valve; and the means for coupling the fuel metering valve and the throttle valve comprises a rack at the other end of the needle valve shaft and a pinion mounted on the diametral shaft of the butterfly valve, the pinion engaging the rack so that rotation of the throttle valve shaft from shut to open causes translation of the needle valve shaft away from the needle valve seat.

* * * * *